US006145699A

United States Patent [19]

Pollock

[11] Patent Number: 6,145,699

[45] Date of Patent: Nov. 14, 2000

[54] HELIX ALIGNMENT DEVICE FOR A PACKAGED-ARTICLE PRODUCT-VENDING MACHINE

[75] Inventor: Richard A. Pollock, Martinsburg, W. Va.

[73] Assignee: Automated Merchandising Systems, Inc., Kearneyville, W. Va.

[21] Appl. No.: 09/069,246

[22] Filed: Apr. 29, 1998

[51] Int. Cl.[7] ..... G07F 11/00

[52] U.S. Cl. ..... 221/75; 221/277

[58] Field of Search ..... 221/75, 261, 311, 221/279, 310, 277; 198/475.1

[56] References Cited

U.S. PATENT DOCUMENTS

| | | | |
|---|---|---|---|
| 3,057,511 | 10/1962 | Mannhardt | 221/75 |
| 3,952,915 | 4/1976 | Pitel et al. | 221/75 |
| 4,149,653 | 4/1979 | Lennartson | 221/75 |
| 4,506,802 | 3/1985 | Lotspeich | 221/75 |
| 4,854,479 | 8/1989 | Callahan et al. | 221/304 |

*Primary Examiner*—Kenneth W. Noland
*Attorney, Agent, or Firm*—Pillsbury Madison & Sutro LLP

[57] ABSTRACT

In a packaged article vending machine having a forwardly, projecting motorized helix supported on a horizontally arranged tray in a wide column delimited by side walls which are disposed substantially further apart than the helix is broad in diameter, the helix is prevented from 'walking' towards the sidewall towards which it would tend to move as the helix rotates, by securing a chock to the tray so as to tangentially engage at least two turns of the helix during a portion of a 360° rotation of the helix, from externally of the helix, and have its rear end located sufficiently out of the way as to avoid possibly poking contact with from the front lower part of an impounded product package being conveyed forwards to eventually become the leading package, next to be vended.

10 Claims, 1 Drawing Sheet

HELIX ALIGNMENT DEVICE FOR A PACKAGED-ARTICLE PRODUCT-VENDING MACHINE

BACKGROUND OF THE INVENTION

The present invention relates to improvements in packaged-article vending machines of the type in which articles yet to be vended are ranked in succession among the turns of a horizontally arranged helix which projects forwardly above a horizontal tray ranked behind a glass front. Upon making payment for and selecting an article to be vended, the customer momentarily pauses and watches, as a motor turns the helix sufficiently to advance the leading packaged article product sufficiently that the leading packaged article falls off the front edge of the tray and descends through a vending space to land in an output chute where it is accessible for retrieval by the customer.

A popular feature of currently available packaged-article product-vending machines of the type referred to above which are snack-vending machines, is having at least one snack-vending column. Typically, this is a comparatively wide column, e.g. 5.5 inches (14 cm) wide, and at least two of the manufacturers which currently sell such machines provide two cooperatingly operated counter-rotatable helices for vending the comparatively large snack packages from such wide columns.

Typically, the product-vending machines which have product impounding and advancing helices arranged in respective side by side columns over a set of vertically spaced horizontally arranged trays, are of modular construction, in the sense that, depending on the sizes of the products which are to be vended, more or fewer trays can be provided, arranged to have more or fewer columns, the narrower columns being served by one helix each, and (in the above-described popular machines), the wider columns each being served by two helices which are arranged to be correspondingly counter-rotated.

Although modularity is considered to be an attractive feature, the need for two motorized helices operating coordinatingly to vend the packages in one wide column is believed not to be an optimal solution, due to the expense and complexity of requiring twice as many motorized helices for vending the product. In other words having it cost more to vend less is not the best, if the extra investment in motorized helices can be avoided.

The trouble with attempting to vend wide packages from a wide column using a single motorized helix, is that a single helix cannot be of arbitrary diameter; as a practical matter, it must be of a standard diameter for interchangeability, and so that its axially rearwardly projecting driving spindle is disposed the correct distance above the supporting tray for the spindle to be plugged through a corresponding hole in an upstanding flange at the rear of the tray for driven engagement with a correspondingly mounted motor. Thus, a single narrow helix even if initially centered in a wide column, when rotated will "walk" towards one side wall of the wide column, in the direction that the helix is rotated, particularly toward the front end of the helix, leaving so much room between the helix and the opposite sidewall of the wide column, that packages of product can slip sideways out of the turns of the helix near the front end of helix, resulting in jamming and/or failure to vend products from the column.

Others have attempted to solve the problem of how to serve a wide column by a single motorized helix by providing the tray floor and/or the column sidewalls with specially shaped plastic or metal V-shaped grooves or ridges that restrain sideways movement of the motorized helix. Although these solve the problem, they do so at considerable expense and at some penalty to interchangability of vending machine modules.

SUMMARY OF THE INVENTION

In a packaged article vending machine having a forwardly projecting motorized helix supported on a horizontally arranged tray in a wide column delimited by side walls which are disposed substantially further apart than the helix is broad in diameter, the helix is prevented from 'walking' towards the sidewall towards which it would tend to move as the helix rotates, by securing a rod to the tray so as to tangentially engage at least two turns of the helix, from externally of the helix, and have its rear end located sufficiently out of the way as to avoid possibly poking contact from the front with the lower part of an impounded product package being conveyed forwards to eventually become the leading package, next to be vended. By preference, the front end of the rod is located about 1.5 helix pitches back from the front edge of the tray, and the rod is of substantially circular transverse cross-sectional shape and of sufficient diameter to prevent the helix from rolling over the rod and walking towards the sidewall.

BRIEF DESCRIPTION OF THE DRAWING

A preferred embodiment of the invention is described in further detail with reference to the attached drawing, in which.

DETAILED DESCRIPTION

Figure 1:
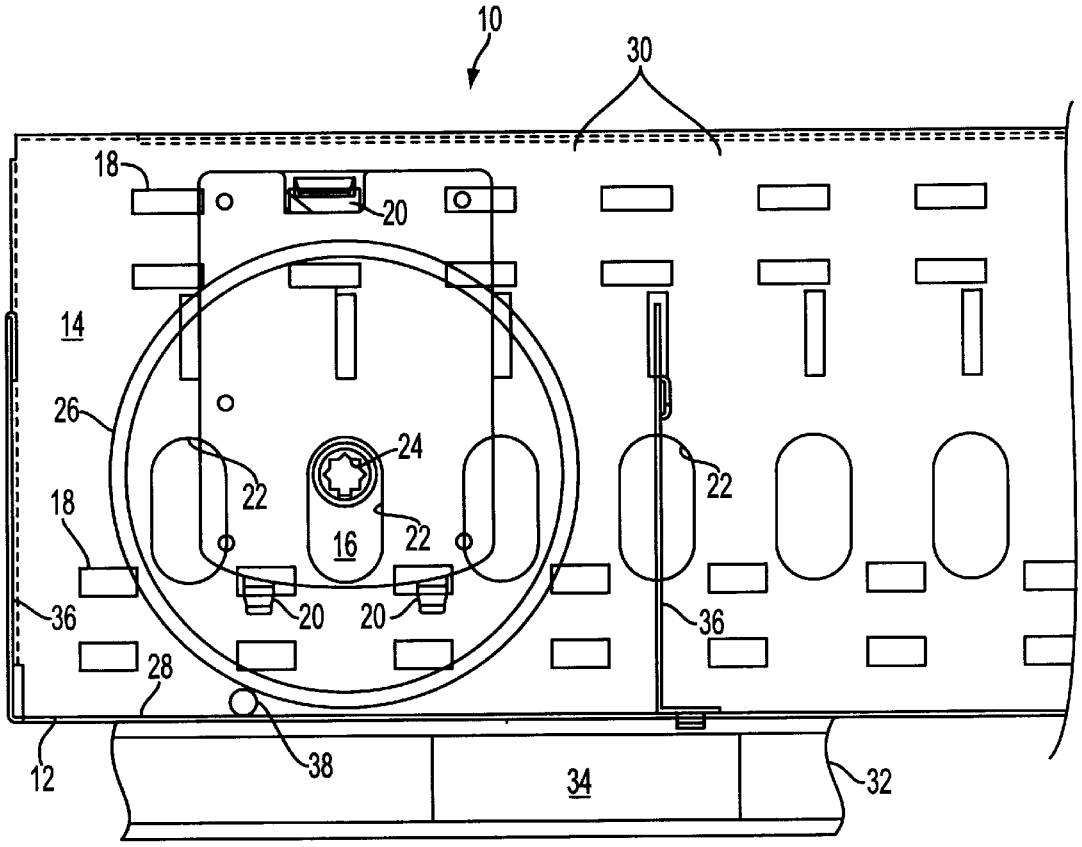
FIG. 1 is a fragmentary, schematic front elevational view of a packaged-article product-vending machine provided with a helix alignment device in accordance with principles of the present invention.

A packaged-article product-vending machine is fragmentarily illustrated at 10 in FIG. 1. The machine 10 as a whole, may be generally of the type which is shown in Pitel et al, U.S. Pat. No. 3,952,915, issued Apr. 27, 1976 and Lennartson, U.S. Pat. No. 4,149,653, issued Apr. 17, 1979.

In the portion which is illustrated (in front elevational view), the machine 10 is shown including a horizontally arranged tray 12 (which generally would be one of several similar trays), supported in the cabinet (not shown) of the machine at a single series at a plurality of different levels, the tray 12 being, for instance, one disposed at an intermediate level, with one or more others (not shown) above it, and one or more others (not shown) below it. Each tray extends from the left inner cabinet supporting wall (not shown) to the right inner cabinet supporting wall (not shown).

Each tray of the machine 10 further includes an upstanding rear wall 14 which is supported sufficiently forwardly of the rear of the outer cabinet (not shown), as to permit each helix operating motor assembly 16 to be mounted to the rear of the respective rear wall 14.

By preference, each rear wall 14 is provided a plurality of regularly spaced locations along its width, above the location of each tray 12, not only with a plurality of openings 18 which permit a helix-operating motor assembly 16 to the rear wall, by appropriate fasteners such as clips 20, but also with openings 22 through which the drive chuck 24 of each motor assembly 16, when so mounted, is available for plugging-in of the rearwardly projecting helix adapter stem (not shown), of non-circular transverse cross-sectional shape, for unidirectional rotation of the helix (suggested at 26) about the longitudinal axis of the helix. Typically, the helix 26 is made of spring steel.

The helix 26 is arranged to be rotated by the motor assembly 15 in a stepwise fashion, e.g. through a fixed number of rotational degrees, or until a certain amount of time has elapsed, and/or until a sensing device senses and reports that an event has occurred, whichever happens first, or whichever happens last. The rear end of the helix 26 is supported from the rear wall 14 by virtue of the stem of the helix adapter being plugged into the chuck 24 of the motor assembly and the motor assembly 16 being mounted by the clips 20 to the rear wall 14. Forwardly of its stem, the helix 26 is supported for rotation by simply resting on the upper surface 28 of the tray 12.

As stated above, by preference the space over the surface 28 on one tray 12 is divided, at least notionally and preferably also physically, into a plurality of side-by-side, forwardly-rearwardly extending horizontal columns 30. In the drawing, two columns are visible; these could (and usually would) be more than two. These may be equally as wide as one another, or different widths, e.g. for respectively vending packages having the same, or different widths, each column being served by (preferably) one stepwise-driven helix 26 (or, less preferably) by two counter-rotating stepwise-driven helices, ranked side by side, with spacing between them.

In the instance depicted, the front edge of the tray 12 is shown further provided with a tab-mounting strip 32, such is conventionally used for holding small price and product identifying cards or chips 34 on the fronts of shelves on traditional supermarket shelving. The purpose of provision of this structure in the machine 10 is similar, i.e. to provide a site for mounting one or more cards or chips 34 at the front of each column indicating the name of the product available from the particular column, and/or its price, and/or the address of the column (e.g. "C7") for indicating the seventh column over from the left on the third tray down from the top of the array of columns on the machine, this address being adapted to be entered by the customer on the selector panel (not shown) on the machine 10, for selecting the particular column the leading product in the respective foremost filled inter-turn space of the helix of which the customer wishes to select to purchase. Typically, these cards or chips 34 are made of flexible material, so as to be able to be resiliently flexed to swap them into or out of the strip 32, and so as to be able to be manually urged leftwise or rightwise so as to assume and maintain a given spatial location relative to the respective column.

The tray 12 typically is made of zinc-coated painted steel sheet, or stainless steel, or a rugged, molded synthetic polymeric plastic material. By preference, the tray 12 has a plurality of holes (not shown) pinched, drilled, pierced, molded or otherwise formed therethrough at a plurality of regularly spaced locations, correspondingly located relative to the sets of openings 18 and 22, for facilitating modular setting up of the machine 10.

For instance, one array of the openings through the tray 12 can be used for mounting at selected sites upright sidewalls 36 which laterally separate respective columns 30 from one another (or which, if provided, separate a leftmost column 30 from the left inner wall (not shown) of the inner cabinet of the machine, or which, if provided, separate a rightmost column 30 from the right inner wall (not shown) of the inner cabinet of the machine).

The helix 26, in addition to its rearwardly axially projecting axially central adapter (not shown), has a plurality of helical turns (typically 8–20, e.g. 14), a diameter typically of 1.5 to 4 inches, about 4–10 cm) and is about 1–3 feet (about 31–93 cm) long, not counting its drive stem. At the forward end, which is preferably flush or nearly flush to the front edge of the shelf, simply runs out, i.e. is "open", so that a product which, by stepwise rotation of the helix while nested between two turns of the helix, while laterally confined between two respective sidewalls 36, upon further stepwise rotation of the helix simply becomes unsupported from below as it is conveyed forwardly of the front edge of the shelf, whereupon it falls through a vend space, typically about 6–9 inches, (about 15–23 cm) in front-to-rear dimension between the front edge of the tray 12 and the rear of the glass front (not shown) of the machine 10. The dimensions given are meant to exemplify; clearly, the machine 10 and its described components could be changed substantially in absolute or relative size without departing from the principles of the invention.

As should be apparent, the column served by the helix 16 and delimited by the sidewalls 36 is substantially broader in the left to right direction than the diameter of the helix 16, correspondingly measured horizontally, is broad.

Accordingly, because the helix is rotationally driven, unidirectionally, from the rear by the motor assembly 16, while resting on the tray 12 over at least the foremost few turns of the helix, if nothing were provided to restrain the helix 16, the helix 16, as it was rotated, would tend to walk, and would actually walk sideways, at least throughout its foremost position until it engaged the respective one of the sidewalls 36. That would leave so much room between the helix and the opposite sidewall (again, if nothing were done to prevent this) that product meant to be confined, while methodically advancing forwards each time the helix was operated to dispense the foremost product from the helix could, instead, fall out of its "pocket" between two turns of the helix, or become jammed between the helix and the sidewall 36 from which the helix which had walked sideways had become most distant.

In accordance with the principles of the present invention, at least one column of the machine 10 which can benefit from having one, is provided with a chock pin 38, which is supported on, disposed on and preferably is removably mounted to the respective tray 12.

The (or each) chock pin 38 can be made of the same rod or wire material as is typically used for manufacturing the helix, of the same or a different (preferably larger) wire gage or rod diameter, e.g. 3/16–3/8 inch (about 0.5–1.0 mm) in diameter. Alternate materials can include fabricated sheet metal or parts molded from plastic or metal.

Figure 2:
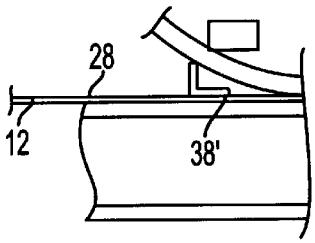
FIG. 2 is a detail of a packaged article product-vending machine similar to the one shown in FIG. 1, but in which the chock pin has a different transverse cross-sectional shape.

There are a number of ways that the chock pin 38 can be mounted to the tray 12. In one preferred arrangement, the pin 38 is vertically flattened towards its front and rear ends, drilled vertically through its two flattened sites and rivets or other connectors (not shown, such as are used for mounting the sidewalls 36 to the tray) via respective holes, not shown, provided in the tray 12. According to another arrangement, the chock pin 38 is provided at its front and rear ends with downwardly projecting prongs (not shown) which project down through respective openings (not shown) in the tray, for reception of securement devices (e.g. grommets frictionally holding the prongs), or being bent-over, or the like. According to another arrangement, the chock pin 38 is brazed or adhered to the tray, e.g. using an epoxy resin (though lack of easy removability would cause this variation to be detractive for many installations). According to another arrangement shown in FIG. 2, the chock pin 38' is a right angle sheet metal part with a vertical leg in the 3/16–3/8 in range and a horizontal leg sufficient in width to permit attachment to the tray 12. In another arrangement, the chock pin is molded or formed with prong tabs which engage holes provided in the tray and or rear vertical wall and secure the pin by means of friction or spring force.

The chock pin 38 needs to be large enough and abrupt enough in transverse dimension that the helix 26, when rotated, will not simply walk up and over it almost as if it were not there. Partly, the necessary minimum dimension is a function of the slinkiness of the spiral and a function of the tractiveness of the upper surface 28 of the tray 12.

The chock pin 38 need not (and preferably does not) extend throughout the entire front-to-rear extent of the tray. Rather, it will perform its intended function if it is long enough to simultaneously engage at least two turns of the helix during a portion of a 360° rotation of the helix, tangentially of the helix, from externally of the helix. The front end of the chock pin preferably is spaced back about 1.5 helix turns from the front edge of the tray 12, and either extends rearwardly to beyond the location of the front of the rearmost "pocket" of the helix that will carry a product package, or is flattened, turned out or down or ramped, such as to substantially eliminate all chances that the rear of the choke pin will stab the front lower part of a product package as the package is conveyed from beyond the rear extent of, and into engagement with the chock pin 38. By preference, the chock pin 38 works so well that the product packages being conveyed forwards simply blithely slidingly engage the chock pin 38 substantially as though it were not there. In other words, from the view point of the product packages, the chock pin 38 easily performs its intended function, without being a nuisance.

Because the chock pin 38 is mounted to the tray 12, its performance of its intended function does not depend on location (or even the existence) of either column sidewall 36, thereby providing greater freedom for design of the column-defining structure of the machine 10.

For rare instances where reversible rotation of the spiral may be provided, a second chock pin 38 constructed, sized, located and mounted like the first, can be provided instead, or in addition, on the opposite side of the spiral from the one shown.

It should now be apparent that the helix alignment device for a packaged-article product-vending machine as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

I claim:

1. A helix alignment device for a packaged-article product-vending machine, comprising:

a generally horizontal tray having an upper surface with a left-to-right widthwise direction and a front-to-rear depthwise direction;

a rear wall extending above said surface;

a helix-rotating motor assembly mounted to said rear wall and having a forwardly presented driving chuck located above said rear surface of said tray;

a horizontally arranged, multiple-turn helix having a longitudinal axis extending in said depthwise direction, said helix being arranged to be driven from the rear by said chuck for rotation about said longitudinal axis with a plurality of turns of said helix in sliding engagement with said surface; and a chock pin mounted to said tray and disposed upon said surface, said chock pin simultaneously tangentially engaging at least two turns of said helix during a portion of a 360° rotation of the helix, from externally of said helix for preventing lateral movement of said helix, wherein said chock pin is removably mounted to said tray and may be selectively located.

2. The helix alignment device of claim 1, further including:

a left sidewall and a right sidewall respectively spaced leftwards and rightwards of said helix and projecting above said surface for defining therebetween for packaged articles to be conveyed and vended by said machine, lateral limits of a respective column.

3. The helix alignment device of claim 1, wherein:

said helix-rotating motor assembly is arranged for unidirectionally rotating said helix discontinuously in a stepwise manner.

4. The helix alignment device of claim 1, wherein:

said chock pin throughout most of the extent thereof in said depthwise direction is substantially circular in transverse cross-sectional shape.

5. The helix alignment device of claim 1, wherein:

said rear wall is provided as part of said tray.

6. The helix alignment device of claim 1, wherein:

said chock pin extends from the front of said tray through the rear wall of said tray.

7. A helix alignment device for a packaged-article product-vending machine, comprising:

a generally horizontal tray having an upper surface with a left-to-right widthwise direction and a front-to-rear depthwise direction;

a rear wall extending above said surface;

a helix-rotating motor assembly mounted to said rear wall and having a forwardly presented driving chuck located above said rear surface of said tray;

a horizontally arranged, multiple-turn helix having a longitudinal axis extending in said depthwise direction, said helix being arranged to be driven from the rear by said chuck for rotation about said longitudinal axis with a plurality of turns of said helix in sliding engagement with said surface;

a chock pin mounted to said tray and disposed upon said surface, said chock pin simultaneously tangentially engaging at least two turns of said helix during a portion of a 360° rotation of the helix, from externally of said helix for preventing lateral movement of said helix; and a left sidewall and a right sidewall respectively spaced leftwards and rightwards of said helix and projecting above said surface for defining therebetween for packaged articles to be conveyed and vended by said machine, lateral limits of a respective column, wherein said chock pin ends both short of the rearmost extent of said tray and the foremost extent of said tray.

8. A helix device according to claim 7, wherein:

said chock pin is removably mounted to said tray and may be selectively located.

9. A helix alignment device for a packaged-article product-vending machine, comprising:

a generally horizontal tray having an upper surface with a left-to-right widthwise direction and a front-to-rear depthwise direction;

a rear wall extending above said surface;

a helix-rotating motor assembly mounted to said rear wall and having a forwardly presented driving chuck located above said rear surface of said tray;

a horizontally arranged, multiple-turn helix having a longitudinal axis extending in said depthwise direction, said helix being arranged to be driven from the rear by said chuck for rotation about said longitudinal axis with a plurality of turns of said helix in sliding engagement with said surface;

a chock pin mounted to said tray and disposed upon said surface, said chock pin simultaneously tangentially engaging at least two turns of said helix during a portion of a 360° rotation of the helix, from externally of said helix for preventing lateral movement of said helix; and a left sidewall and a right sidewall respectively spaced leftwards and rightwards of said helix and projecting above said surface for defining therebetween for packaged articles to be conveyed and vended by said machine, lateral limits of a respective column, wherein said chock pin throughout most of the extent thereof in said depthwise direction is a vertical rectangular structure in transverse cross-sectional shape.

10. A helix device according to claim 9, wherein:

said chock pin is removably mounted to said tray and may be selectively located.

* * * * *